United States Patent [19]

Perrelli

[11] 4,273,526

[45] Jun. 16, 1981

[54] AUTOMATIC DAMPER CONTROL

[76] Inventor: Nicholas J. Perrelli, 131 Woodward Dr., West Seneca, N.Y. 14224

[21] Appl. No.: 56,836

[22] Filed: Jul. 12, 1979

[51] Int. Cl.[3] ..... F23N 3/00

[52] U.S. Cl. ..... 431/20; 431/19; 236/1 G; 250/231 P; 250/231 R

[58] Field of Search ..... 431/13, 19, 20; 236/1 G, 45; 250/231 P, 231 R; 361/157, 174; 73/705, 714, 723

[56] References Cited

U.S. PATENT DOCUMENTS

| | | | |
|---|---|---|---|
| 3,067,617 | 12/1962 | Buck | 250/231 P |
| 3,305,691 | 2/1967 | Hock | 250/231 R |
| 3,364,739 | 1/1968 | Foster | 250/231 P |
| 3,490,295 | 1/1970 | Westby et al. | 250/231 R |
| 3,628,024 | 12/1971 | Ciemochowski | 250/231 P |
| 3,768,956 | 10/1973 | Mueller et al. | 431/20 |
| 3,788,795 | 1/1974 | Zeitlin | 431/13 |

FOREIGN PATENT DOCUMENTS

| | | | |
|---|---|---|---|
| 1128073 | 4/1962 | Fed. Rep. of Germany | 431/19 |

*Primary Examiner*—Samuel Scott
*Assistant Examiner*—Lee E. Barrett
*Attorney, Agent, or Firm*—Christel, Bean & Linihan

[57] ABSTRACT

An automatic damper control comprising: damper means for use in a flue or the like; diaphragm means adapted to expand and contract in response to pressure variations in the flue; and sensor means for sensing the pressure in the flue. The sensor means is connected to the diaphragm means and comprises means for generating a plurality of beams of light. The sensor means further comprises collimating means adapted to collimate each of the beams of light onto a photoreceptor. The damper control also comprises blocking means for blocking at least one of the beams of light. The blocking means is operatively associated with the diaphragm means and is adapted to be displaced relative to the beams of light in response to movement by the diaphragm means. Drive means are additionally provided for moving the damper means in response to pressure variations in the flue.

7 Claims, 4 Drawing Figures

AUTOMATIC DAMPER CONTROL

BACKGROUND OF THE INVENTION

1. Field of the Invention

The invention relates to an automatic damper control for use in conjunction with flues, vents and the like, which serves to effectively reduce and optimize energy consumption.

2. Description of the Prior Art

In view of recent emphasis on energy conservation, the advantages of precise and efficient damper control in vents, flues and exhausts is self-evident. The following three patents are exemplary of systems previously disclosed:

U.S. Pat. No. 3,788,795 to ZEITLIN discloses a flue draft pressure operated monitoring meter for use in a switching circuit which acts to intermittently interrupt a circuit so as to control the direction of rotation of a chimney damper motor. Pivoting of the damper is monitored by means of a pointer gauge which intercepts a light beam passing between a lamp and a photocell.

German Pat. No. 1,242,787 to SUNDBERG discloses an automatic draft control device wherein the diaphragm of an aneroid monometer measures the draft. The diaphragm is connected to a tongue which floats between two contacts so that changes in pressure result in contact being made thus activating a servo-mechanism.

U.S. Pat. No. 4,046,318 to RIPLEY discloses a damper arranged within a vent which is adapted to be pivotably mounted within the vent. The damper is operated by means of a solenoid controlled by a thermostat. The damper is provided with a vent hole such that gases are free to pass through the damper in sufficient quantity so as to come into contact with the thermostat mounted above the damper.

While each of the patents attempts to provide a system in which the damper is effectively regulated as a function of system conditions, precise and optimum damper control have yet to be achieved. Thus, while prior art devices have relied upon full open-full closed type dampers, a demand remains for a more accurate control system. The automatic damper control of the invention achieves the desired improved operating characteristic and relies upon a unique sensor mechanism to accomplish this purpose.

Although light sensors as are exemplified by U.S. Pat. Nos. 2,879,690; 3,679,906; 3,840,868; and 4,096,383 exemplify conventional light sensor devices, the invention relies upon a novel light sensing mechanism used in conjunction with an automatic vent damper to provide precise and accurate damper control as a function of operating conditions.

SUMMARY OF THE INVENTION

It is therefore an object of the invention to provide an automatic damper control for use in conjunction with vents and exhausts for effectively and efficiently minimizing and optimizing energy consumption.

It is a further object of the invention to provide a light operated sensor means for use in conjunction with an automatic damper control for purposes of providing improved sensitivity.

It is yet another object of the invention to provide an automatic damper control adapted to position the damper in the optimum position and which is not limited to positioning the damper in the full open or full closed position.

These and other objectives of the invention are fulfilled by means of the automatic damper control of the invention which comprises a damper for use in a flue or other stack; diaphragm means adapted to expand and contract in response to pressure variations in the flue; and sensor means for sensing the pressure within the flue. The sensor means are connected to the diaphragm means and comprise a means for generating a plurality of beams of light. The sensor means further comprises collimating means adapted to collimate each of the beams of light onto a photoreceptor. Blocking means are provided for blocking at least one of the beams of light as it travels from the light generating means to the photoreceptor. The blocking means are operatively associated with the diaphragm means and are adapted to be displaced relative to the beams of light in response to movement by the diaphragm means. Finally, drive means are provided for moving the damper means in response to pressure variations in the flue.

In a preferred embodiment of the invention the diaphragm means used comprises a bellows. Furthermore, in one embodiment of the invention the blocking means is mounted on the bellows such that the blocking means is adapted to move relative to the collimating means as the bellows expands and contracts in response to pressure variations in the flue.

In a most preferred embodiment of the invention, the collimating means comprises a collimating plate arranged between the light generation means for generating the beams of light and the photoreceptors. The collimating plate comprises an orifice aligned with each of the light generation means and the photoreceptors for purposes of collimating each of the beams of light onto each of the photoreceptors. As a part of this embodiment the collimating plate comprises two orifices through which the light is permitted to pass. The blocking means comprise a blocking plate which moves relative to each of the orifices in response to pressure variations within the flue.

BRIEF DESCRIPTION OF DRAWINGS

With reference to the annexed drawings.

DESCRIPTION OF PREFERRED EMBODIMENTS

Figure 2:
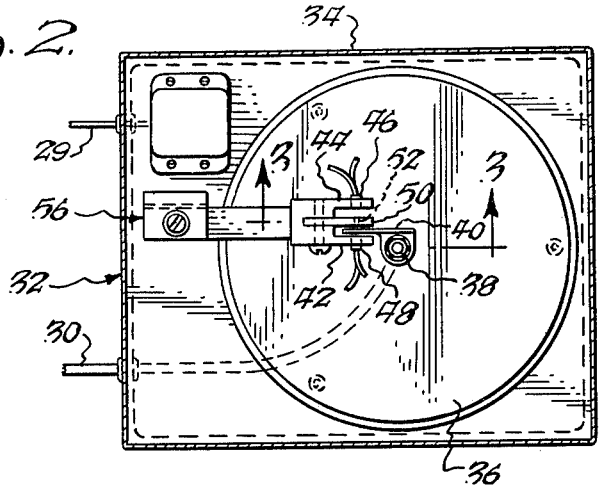
FIG. 2 is a top view of the sensor shown in FIG. 1 along line 2—2.

According to the invention, an automatic damper control is provided which first comprises a damper means. The damper means may in effect be any conventional damper, diverter, or the like capable of controlling fluid flow through a passage. Specifically, the damper means is to be used in conjunction with a flue, vent, chimney, exhaust or the like to control gas flow through the flue. The damper is moved by a motor and is additionally provided with means for automatically opening the damper in the event of power failure.

The damper of the invention may be an adjustable plate which may be positioned anywhere from full open to full closed within a vent.

Pressure within the vent or flue is preferably sensed by means of a pressure takeoff port through which a sensor is inserted. Pressure variations pass from the sensor into the sensor means where such pressure variations are translated into damper control information.

The sensor means comprises an aneroid monometer arrangement having a bellows which expands and contracts in response to pressure variations in the flue or vent. Sensor means is provided with means for generating two beams of infrared rays which are received on a pair of corresponding photoreceptors. The photoreceptors are preferably in the form of phototransistors. A blocking means in the form of blocking plate or flag is provided although a variety of other means may likewise be used. The flag is connected to the bellows such that expansions and contractions in the bellows result in the flag sliding reciprocally in the vertical direction. When properly arranged, the flag is adapted to move relative to the beams of light emitted by each of the light generating means. The flag is adapted to interfere with each of the beams depending on the pressure within the vent. The flag has a vertical dimension such that it is capable of interfering with both of the light beams generated which corresponds to the neutral position of the sensor.

According to the invention, a collimating means is provided for collimating the beams of light generated by the light generating means so as to result in finely collimated beams of light. According to a preferred embodiment, the collimating means comprises a collimating plate provided with two orifices spaced from one another by a distance equal to the distance between each of the light generating means which also corresponds to the distance between each of the photoreceptor means. Using a collimating plate with orifices positioned therein, the orifices are preferably of as small a diameter as possible so as to provide a finely collimated beam of light. Preferred diameters are of the range 0.013" to 0.020". The collimating means is arranged adjacent to the photoreceptors and is spaced therefrom by means of the blocking means.

A logic circuit is connected to the photoreceptors such that signals emitted by each of the photoreceptors are received by the logic circuit and converted into instructions transmitted to the motor used to drive the damper. The logic circuit used makes it possible to regulate the position of the damper between the full open and full closed positions as a function of pressure within the vent in relation to the desired pressure.

Figure 1:
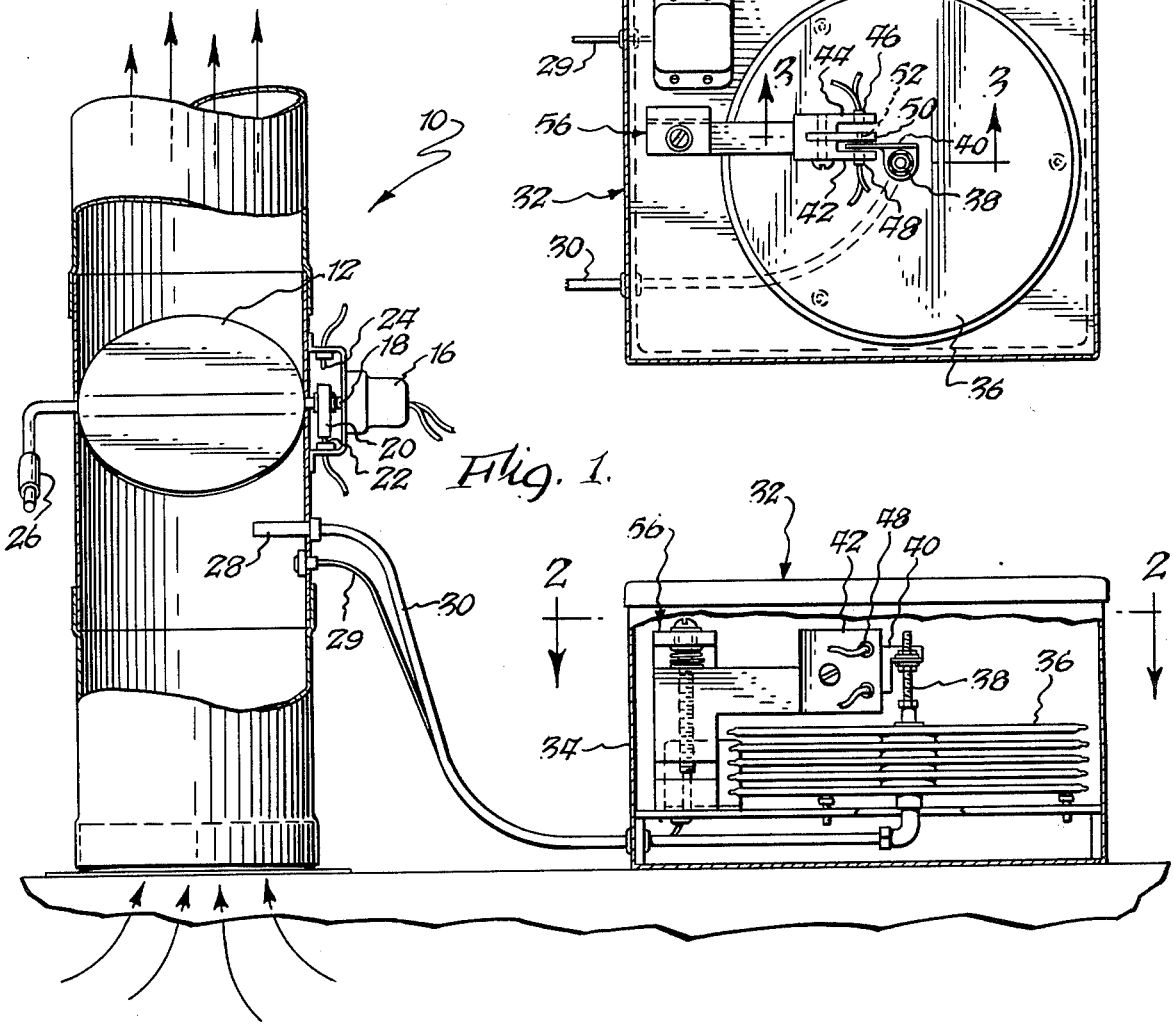
FIG. 1 is a cross-sectional view of the damper and sensor means of the invention.

As shown in FIG. 1, a flue, vent, or the like 10 is provided with a damper 12 driven by a motor 16. The drive shaft 18 of the motor comprises a cam 20 adapted to make contact with contact switches 22 and 24 depending upon the position of the drive shaft. The damper is provided with a weighted arm 26 which serves to automatically move the damper to the open position such as may be the case in the event of a power failure.

Probe 28 is arranged in a takeoff port in the wall of the vent or flue 10 for purposes of sensing pressure within the flue.

The sensor means 32 held within a container 34 is connected to the takeoff tube or probe 28 through line 30. The sensor means comprises a bellows 36 adapted to expand and contract in response to pressure variations in the vent or flue. A bolt 38 is mounted on top of the bellows and is adapted to receive a flag 40. The flag 40 thus slides upwardly and downwardly in response to movement by the bellows 36.

The automatic damper control system of the invention is adapted to be used in conjunction with a gas-fired furnace so as to maintain optimum draft under all operating conditions. In operation, the sensor means continuously monitors the draft in the vent and compensates for changes in wind velocity and furnace operating conditions. Adjustment means 56 are provided for setting the optimum neutral position of flag 40 (FIG. 1) and the system acts to maintain optimum draft at all times.

As shown in FIG. 2, the flag 40 is positioned between side walls 42 and 44. Side wall 44 serves to support infrared light generating means 46 while side wall 42 supports photoreceptor 48. Collimating means are provided in the form of a collimating plate 50 which comprises an orifice 52 lined with each of the two light generating means for purposes of collimating light emitted by the light generating means such that only a finely collimated beam reaches the photoreceptors 46.

Figure 3:
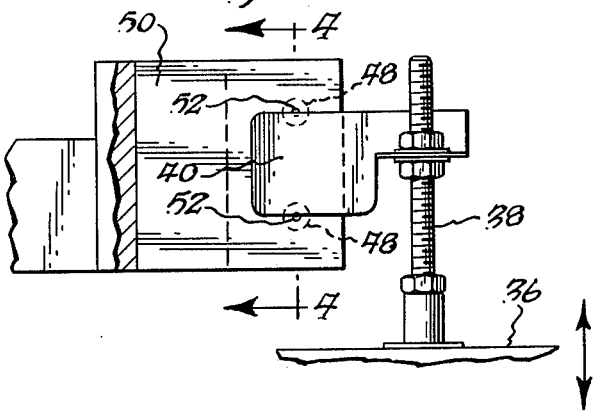
FIG. 3 is a view of the blocking means and collimating means along line 3—3 of FIG. 2.

As shown in FIG. 3, the flag 40 is mounted behind the collimating plate such that light emitted by the light generating means 46 is collimated through collimating means in the form of collimating orifices 52 in collimating plate 50. Flag 40 is adapted so as to extend in the vertical direction a distance equal to the spacing between the two collimating orifices 52 such that when the bellows is in its neutral position each of the orifices 52 is just covered by means of flag 40 thus blocking light from reaching the photoreceptors 48.

Although the invention has been described with respect to a system in which the neutral bellows position corresponds to both light beams being blocked by flag 40, the system could likewise operate by using a flag which does not extend the distance between the two orifices 52 such that the neutral position of the bellows corresponds to both light beams reaching photoreceptors 48. This second embodiment and other variations thereof could easily be accomplished by means of appropriate modifications in the logic circuit used in conjunction with the sensor means.

Figure 4:
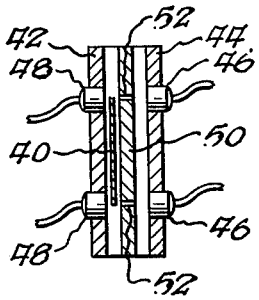
FIG. 4 is a front view of the sensor means along line 4—4 of FIG. 3.

FIG. 4 is a cross-sectional view of the side walls and flag of the sensor means. As has been previously indicated, the light generating means 46 is spaced from the photoreceptors 48 first by means of flag 40, followed by blocking plate 50 with collimating orifices 52.

The system is adapted to be used in conjunction with a thermostat which controls a burner so that the damper opens or closes as required when the fire of the burner is on in order to provide optimum draft for maximum operating efficiency. The damper is closed at the end of each fire cycle so as to retain heat within the unit being heated.

Although only two contact sensor switches are illustrated for purposes of indicating full open and full closed position of the damper, a third switch, not shown, is relied upon to energize the burner control relay.

A temperature sensor 29 arranged within the stack or flue (FIG. 1) is wired in series with the motor clutch so that in the event of a malfunction, when stack temperature rises, the sensor opens a thermo-switch which serves to de-energize the motor clutch with the result that the damper goes to the full open position by virture of weight 26.

A unique advantage of the invention is that by carefully controlling the vertical dimensions of the flag as well as using an appropriately small orifice diameter, it is possible to achieve a system sensitivity on the order of 0.0001 inches of deflection for full off to full on. As may be seen from the device disclosed, the assembly is essentially frictionless since the flag does not contact the rest of the system at any point and accuracy and repeatability are governed only by the characteristics of the bellows. It is thus easily possible, with proper choice of bellows to very accurately maintain a draft of 0.02 inches of water within the system.

Quite obviously the more closely the vertical dimension of the flag approximates the distance between each of the orifices in the collimating plate the greater the sensitivity of the system will be.

Although not described in detail, the logic circuit used is an integrated circuit used to provide excitation to the light emitter and to amplify the output of the photoreceptors. The integrated circuit generates a square wave output of approximately five khz which, through a current amplifier, drives the emitter. When the photoreceptor is activated by means of the infrared light beam, the signal received is amplified and filtered by the integrated circuit and appears as a logic level, either high or low, at the output. In the embodiment shown, the output is normally high level when no light strikes the photoreceptor. A circuit is provided for use with each sensor pair to provide the damper open and closed signals to the logic circuits. The logic system controls the damper drive motor and a burner control relay. The normal operating mode with the burner off is to fully close the damper. When the thermostat first calls for heat, the logic circuit first opens the damper completely. At this point the burner is turned on and the automatic positioning circuit is activated. During the entire interval that the burner is on, the logic circuit processes signals from the sensor and controls the drive motor to optimally positon the damper as required to maintain optimum draft. This positioning can correspond to any position from full open to full closed depending upon conditions. When the thermostat is satisfied, the burner is turned off and the damper closes fully awaiting the next heat cycle. Other contingencies may likewise be taken into account.

A power failure will cause the damper to open and without power the heated residence will cool down and the thermostat will demand heat. When power is reapplied the burner will automatically go on and the automatic control will be activated thus putting the system through its normal sequence. Preferably, the logic circuit used is of a low power-high noise immunity type making it suitable for continuous operation in noisy environments and providing low operating costs.

Although the invention has been described with respect to specific embodiments and devices, it is to be understood that the invention is not limited to the means specifically disclosed.

What is claimed is:

1. An automatic damper control comprising:

(a) a damper for use in a flue or the like;

(b) diaphragm means adapted to expand and contract in response to pressure variations in said flue;

(c) sensor means for sensing the pressure in said flue, said sensor means being connected to said diaphragm means, said sensor means comprising means for generating a plurality of beams of light, photoreceptors, and collimating means adapted to collimate each of said beams of light onto a photoreceptor;

(d) blocking means for blocking at least one of said beams of light, said blocking means being operatively associated with said diagphragm means and being adapted to be displaced relative to said beams of light in response to movement by said diaphragm means;

(e) drive means for moving said damper means in response to pressure variations in the flue;

(f) wherein said collimating means comprises a collimating plate arranged between said light generating means and said photoreceptors, said collimating plate comprising an orifice aligned with each of said light generating means and said photoreceptors so as to collimate each of said beams of light onto each of said photoreceptors;

(g) wherein said blocking means comprises blocking plate means arranged between said means for generating said beams of light and said photoreceptors adjacent said collimating plate;

(h) said blocking plate means being arranged relative to said orifices such that a single one of said orifices may be exposed in response to movement of said blocking plate means; and (i) wherein said diaphragm means comprises a bellows, said blocking plate means being mounted on said bellows such that said blocking plate means move relative to each of said orifices as said bellows expands and contracts in response to pressure variations in the flue.

2. The automatic damper control as defined by claim 1 wherein said sensor means further comprises a probe adapted to be arranged within the flue to sense said pressure variations, said probe being arranged in fluid communication with said bellows.

3. The automatic damper control as defined by claim 1 wherein said blocking plate means is arranged between said photoreceptors and said collimating plate.

4. The automatic damper control as defined by claim 1 or claim 3 wherein said sensor means comprises two light generating means, said collimating plate comprises two orifices, and said blocking means comprises a blocking plate.

5. The automatic damper control as defined by claim 4 wherein said blocking plate is adapted to extend from one of said orifices to the other of said orifices but not substantially beyond said orifice such that each of said orifices may be blocked by said blocking plate and furthermore such that a single one of said orifices may be exposed in response to movement of said blocking plate.

6. The automatic damper control as defined by claim 1 further comprising a logic circuit adapted to receive signals emitted from each of said photoreceptors whereby said logic circuit activates said drive means to move said damper in response to pressure variations in the flue such that said damper may be moved and maintained in any position between fully open and fully closed.

7. The automatic damper control as defined by claim 6 in combination with a flue and a fuel burner.

* * * * *